US005938045A

United States Patent [19]

Makino et al.

[11] Patent Number: 5,938,045

[45] Date of Patent: Aug. 17, 1999

[54] CLASSIFYING DEVICE

[75] Inventors: Nobuyasu Makino; Kenichi Uehara, both of Numazu; Keiko Watanabe, Shizuoka-ken; Satoshi Okano, Yokohama; Kazuyuki Matsui; Eisuke Sugisawa, both of Fuji, all of Japan

[73] Assignee: Ricoh Company, Ltd., Tokyo, Japan

[21] Appl. No.: 08/782,218

[22] Filed: Jan. 13, 1997

[30] Foreign Application Priority Data

Jan. 12, 1996 [JP] Japan ..... 8-021873
May 30, 1996 [JP] Japan ..... 8-157407

[51] Int. Cl.[6] ..... B04B 5/12

[52] U.S. Cl. ..... 209/713; 209/714; 209/142; 209/143

[58] Field of Search ..... 209/713, 714, 209/146, 143, 142

[56] References Cited

U.S. PATENT DOCUMENTS

| | | | |
|---|---|---|---|
| 2,030,612 | 2/1936 | Sturtevant | 209/714 |
| 3,040,888 | 6/1962 | Hosokawa et al. | 209/714 |
| 3,306,443 | 2/1967 | Sereno et al. | 209/143 |
| 4,689,411 | 8/1987 | Folsberg | 209/714 |
| 5,120,431 | 6/1992 | Cordonnier | 209/714 |
| 5,301,812 | 4/1994 | Garret et al. | 209/714 |
| 5,421,462 | 6/1995 | Hofbauer et al. | 209/143 |
| 5,435,442 | 7/1995 | Howell | 209/143 |
| 5,458,245 | 10/1995 | Heckel et al. | 209/146 |
| 5,511,668 | 4/1996 | Keuschnigg | 209/714 |
| 5,533,629 | 7/1996 | Ito et al. | 209/714 |
| 5,624,039 | 4/1997 | Folsberg | 209/714 |

*Primary Examiner*—David A. Buccl
*Assistant Examiner*—Douglas Hess
*Attorney, Agent, or Firm*—Cooper & Dunham LLP

[57] ABSTRACT

A classifying device including an upper, dispersing chamber for dispersing solid particles supplied thereto together with a carrier gas, and a lower, classifying chamber directly connected to a lower end of the dispersing chamber for centrifugally classifying the solid particles, supplied from the dispersing chamber to the classifying chamber, into relatively fine particles and relatively coarse particles. The dispersing chamber is provided with a rotor for swirling the solid particles in the dispersing chamber.

27 Claims, 16 Drawing Sheets

CLASSIFYING DEVICE

BACKGROUND OF THE INVENTION

1. Field of the Invention

This invention relates to a device for classifying solid particles, such as toner for use in electrophotography, into coarse and fine particles.

2. Description of Prior Art

One commercially available device for removing fine toner particles is shown in FIG. 1 (DISPERSION SEPARATOR manufactured by Japan Pneumatic Inc.). This device includes a dispersing chamber 102, a feed port 101 for feeding a jet stream composed of toner particles and a carrier gas into the dispersing chamber 102 in the direction tangential to the inside periphery of the cylindrical housing, and classifying chamber 103 connected to the bottom of the dispersing chamber 102. The toner particles introduced in a tangential direction into the dispersing chamber 102 are circumferentially distributed or dispersed and are passed to the classifying chamber 103, where the solid particles are separated by centrifugal force into relatively coarse particles an relatively fine particles. The coarse particles are collected in a collecting chamber 105 as a product, while the fine particles are discharged through a pipe 104 connected to an evacuating deice (not shown).

SUMMARY OF THE INVENTION

It has been found that the above conventional classifying device has a problem that fine particles are not completely separated from coarse particles. It has also been found that fine particles are apt to form aggregates due to van der Waas force, static electricity, etc. before they are introduced from the feed port 101. Such aggregates are not separated in the classifying chamber 103 and are collected together with coarse particles in the collecting chamber 105 as a final product. The aggregates in the final produce are often dissociated during transportation and use into fine particles, thereby causing degradation of the quality of toner images.

It is, therefore, the prime object of the present invention to provide a classifying device which can effectively remove fine particles inclusive aggregates of fine particles from coarse particles.

In accomplishing the above object, there is provided in accordance with one aspect of the present invention a classifying device comprising an upper, dispersing chamber for dispersing solid particles supplied thereto together with a carrier gas, and a lower, classifying chamber directly connected to a lower, classifying chamber directly connected to a lower end of said dispersing chamber for centrifugally classifying said solid particles, supplied from said dispersing chamber to said classifying chamber, into relatively fine particles and relatively coarse particles, said device being characterized in that said dispersing chamber is provided with a rotor for swirling said solid particles in said dispersing chamber.

In another aspect, the present invention provides a device for classifying solid particles into relatively fine particles and relatively coarse particles, comprising:

an upper cylindrical housing having a vertically oriented central axis and defining therewithin a dispersing chamber, said upper housing being open ended at a bottom thereof;

feed port means connected to an upper part of said housing member for feeding a jet stream comprising said solid particles and a carrier gas into said dispersing chamber in the direction tangential to the inside periphery of said cylindrical housing;

a core plate member coaxially disposed within said dispersing chamber to define an annular gap between the inside periphery of said cylindrical housing member and said core plate member;

a lower housing having a cylindrical section coaxial with said upper housing and defining therewithin a classifying chamber, said classifying chamber being connected to said bottom of said upper housing so that said classifying chamber is in fluid communication with said dispersing chamber through said annular gap, said lower housing having a collecting chamber below said classifying chamber;

a pipe member having one end located outside said lower housing for connection to evacuating means, said pipe member extending into and terminating at the other end in said classifying chamber to provide a fine powder exhaust port coaxial with said cylindrical section;

vanes provided in said cylindrical section of said lower housing and arranged so that air is fed to said classifying chamber in the direction tangential to the inside periphery of said cylindrical section to form a vortex flow when said classifying chamber is evacuated by said evacuating means, an annual, tapered plate member extending radially outward and obliquely downward from the periphery of said fine powder exhaust port and terminating to provide an annular space between the inside periphery of said cylindrical section and the outer periphery of said tapered plate member, so that said classifying chamber is in fluid communication with said collecting chamber through said annular space, and a rotor disposed within said dispersing chamber and having a rotatable shaft extending coaxially with said cylindrical housing and a plurality of blades secured to said shaft for rotation therewith, whereby said solid particles introduced through said feed port means are dispersed by the revolution of said blades, then passed to said classifying chamber and separated into relatively small particles discharged through said fine powder exhaust port and relatively coarse particles collected in said collecting chamber through said annular space.

BRIEF DESCRIPTION OF THE DRAWINGS

Other objects, features and advantages of the present invention will become apparent from the detailed description of the preferred embodiments which follows, when considered in light of the accompanying drawings, in which.

Figure 2:
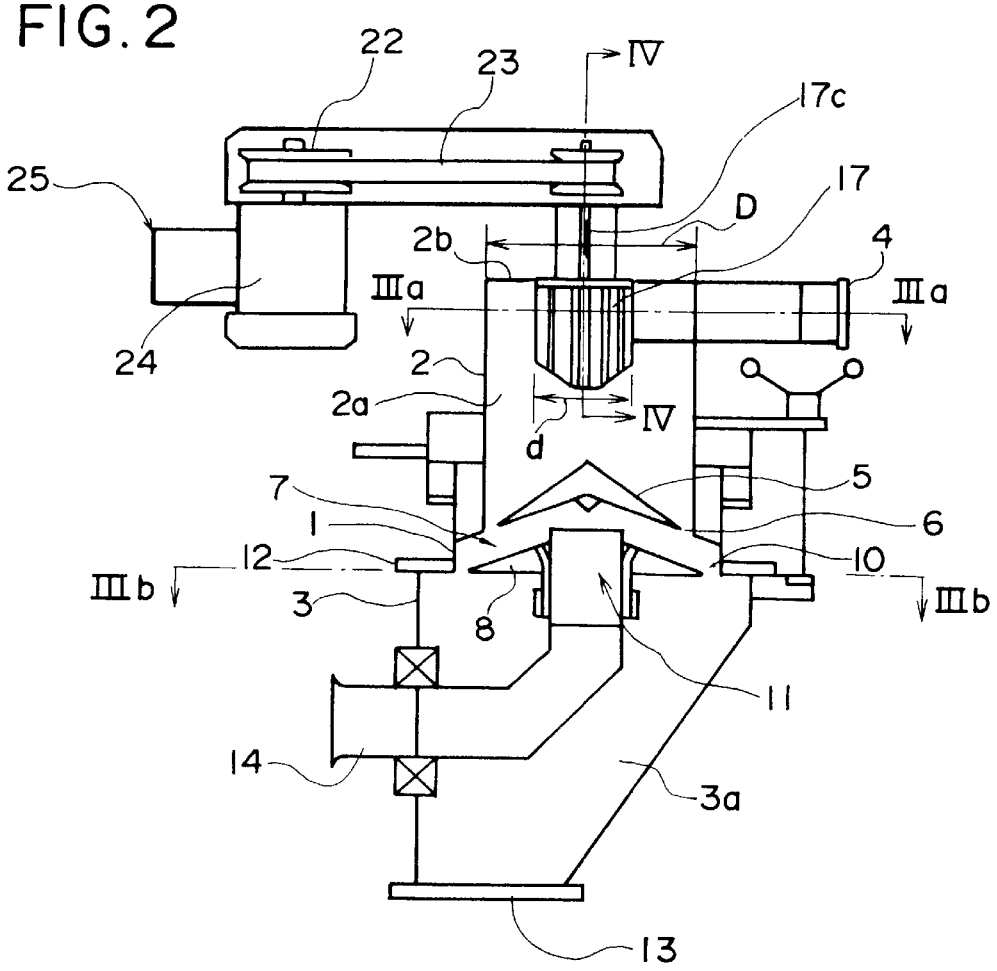
FIG. 2 is an elevational cross-sectional view diagrammatically showing one embodiment of a classifying device according to the present invention.
Figure 3A:
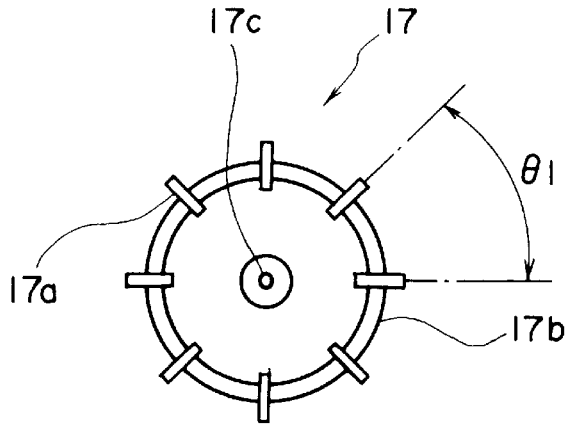
Figure 3B:
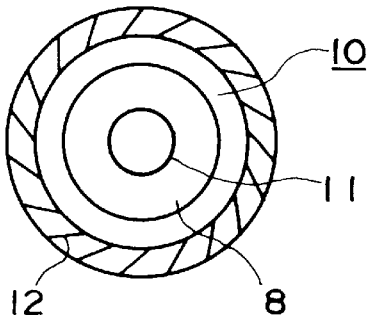
Figure 4:
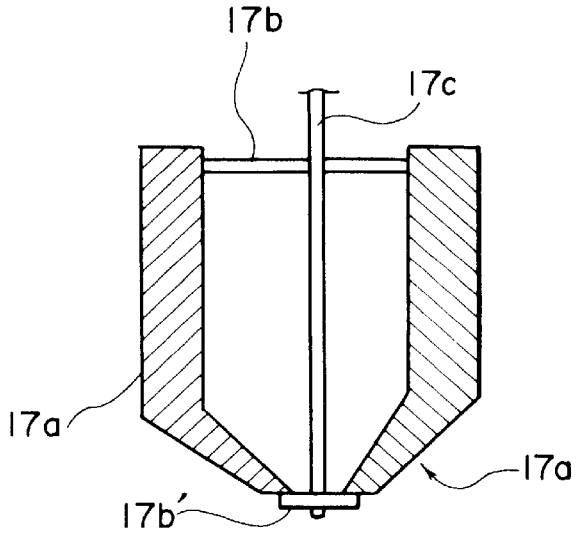
Figure 5:
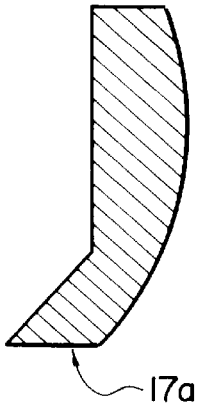
Figure 6:
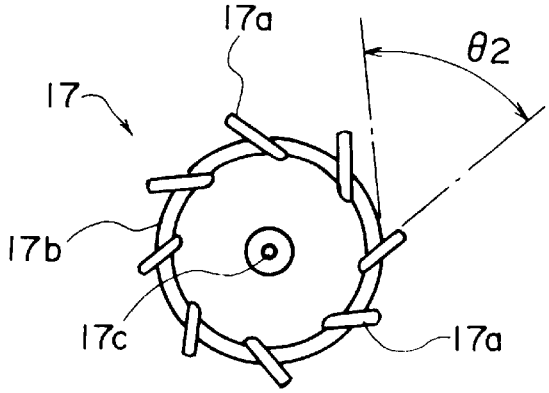

FI. 3(*a*) is a sectional view taken along the line IIIa—IIIa in FIG. 2 and showing a rotor structure;

FIG. 3(*b*) is a sectional view taken along the line IIIb—IIIb in FIG. 2;

FIG. 4 is a fragmentary, enlarged sectional view taken along the line IV—IV in FIG. 2 and showing a rotor structure;

FIG. 5 is a fragmentary view showing an example of a blade;

FIG. 6 is a view similar to FIG. 3(*a*) showing another example of a rotor structure.

Figure 7:
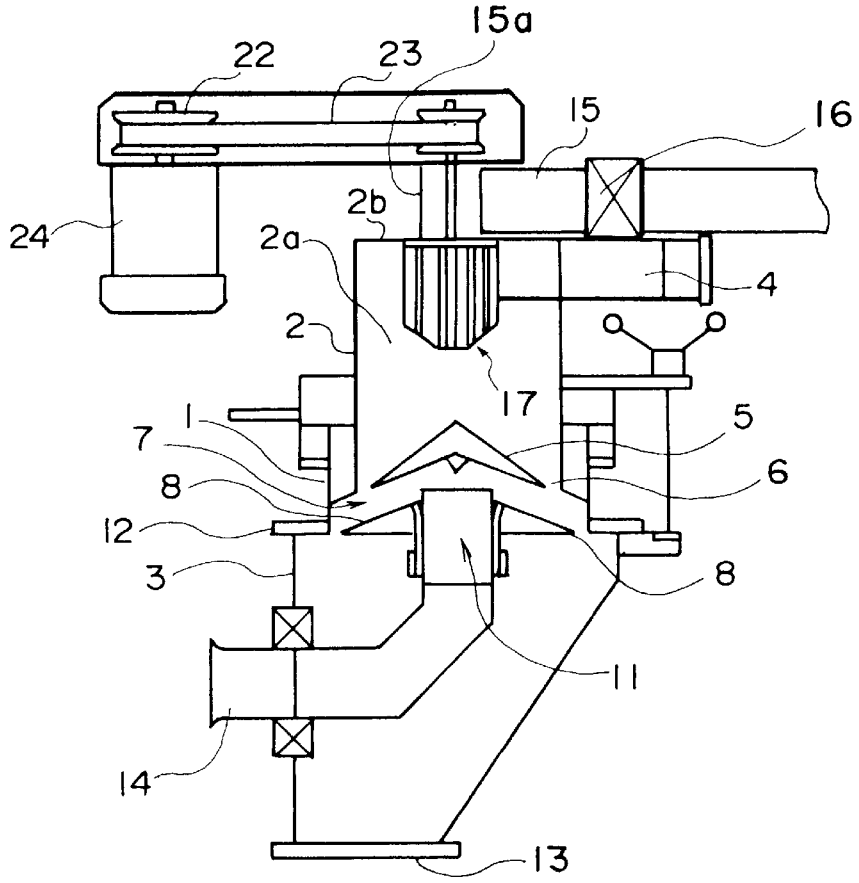
Figure 8:
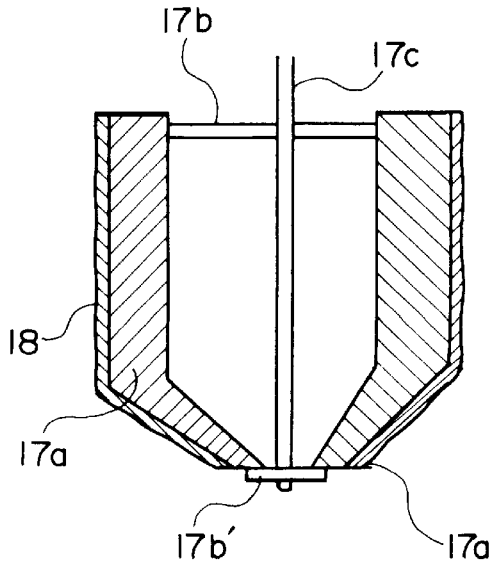
Figure 9:
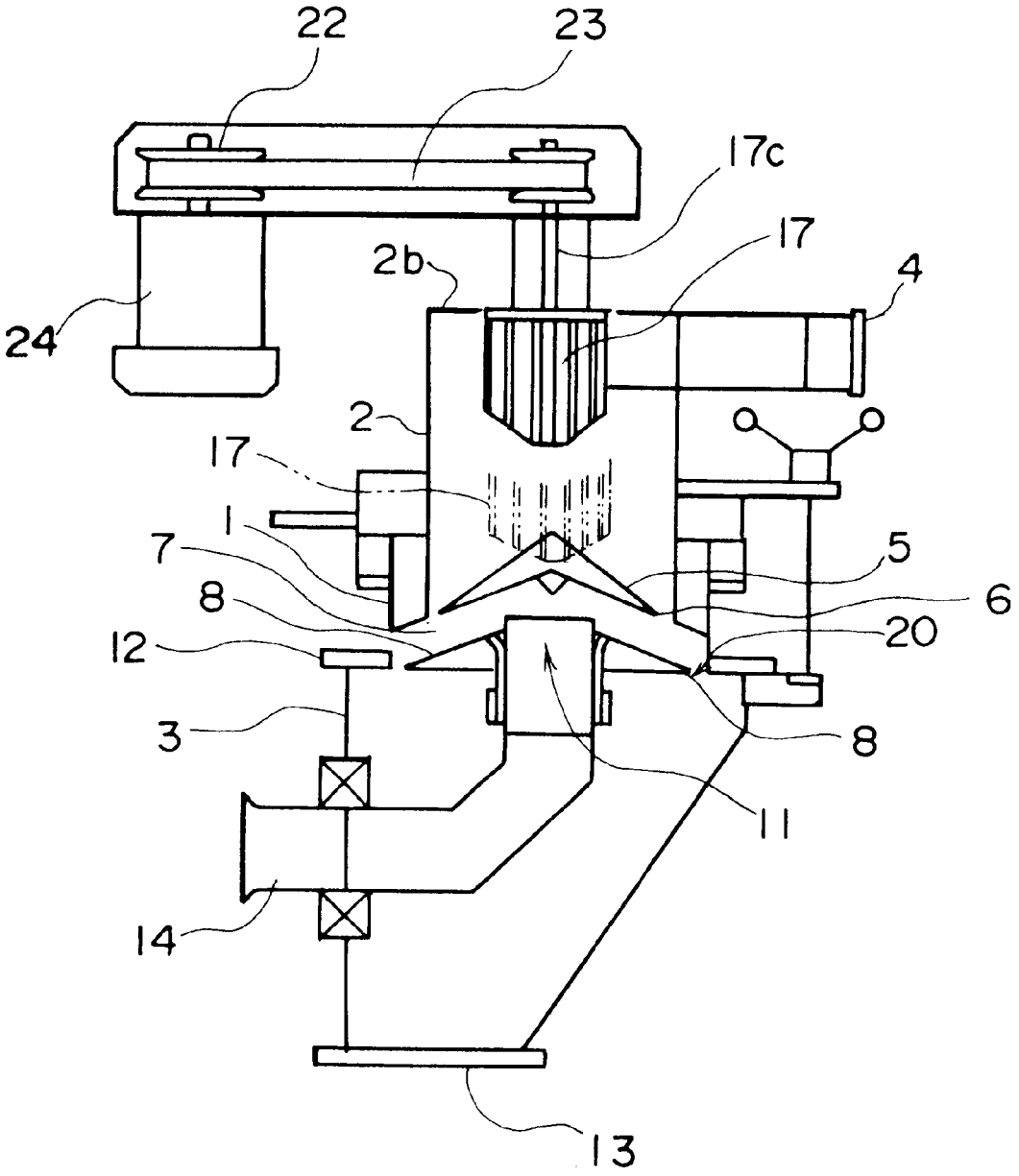
Figure 10:
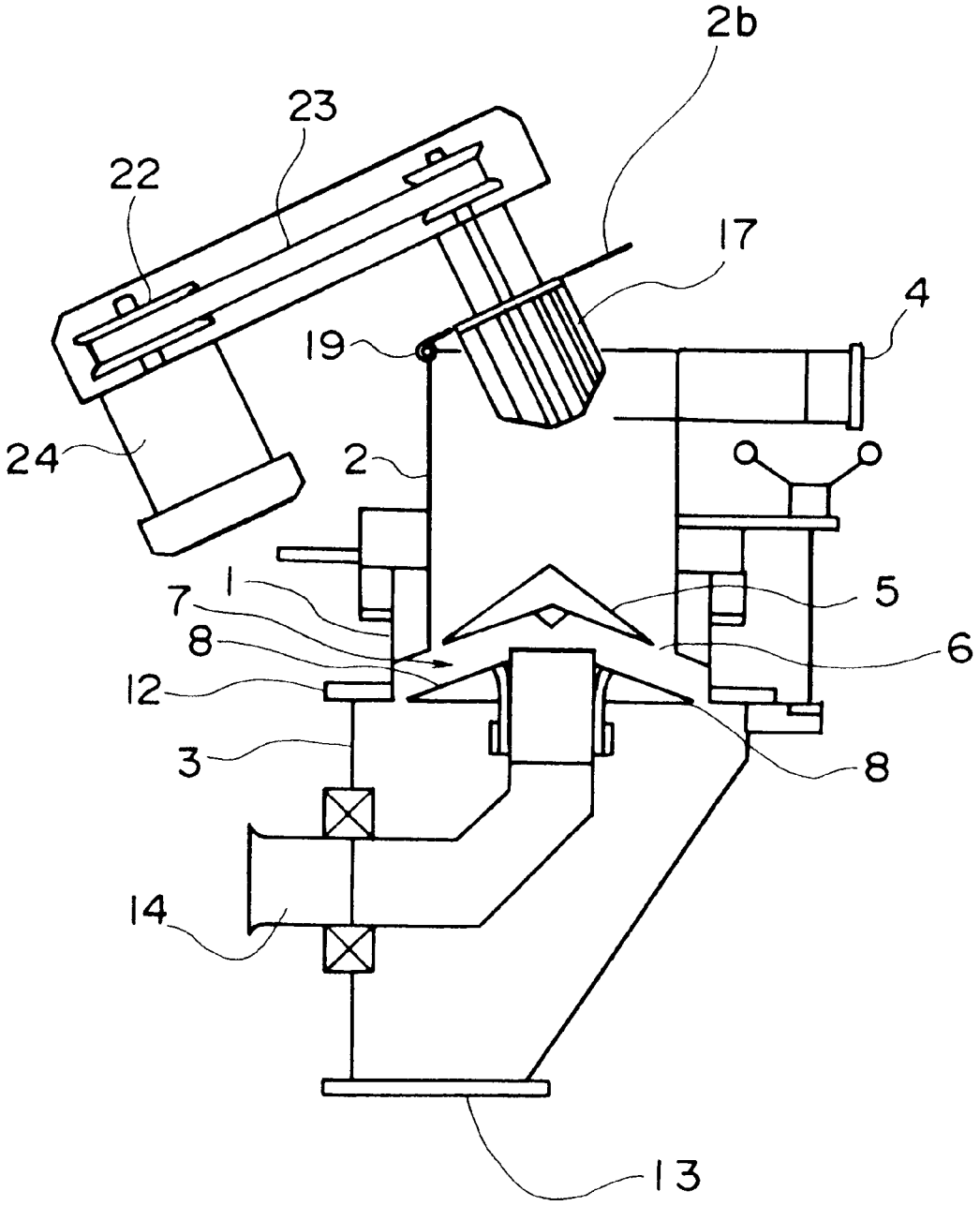
Figure 11:
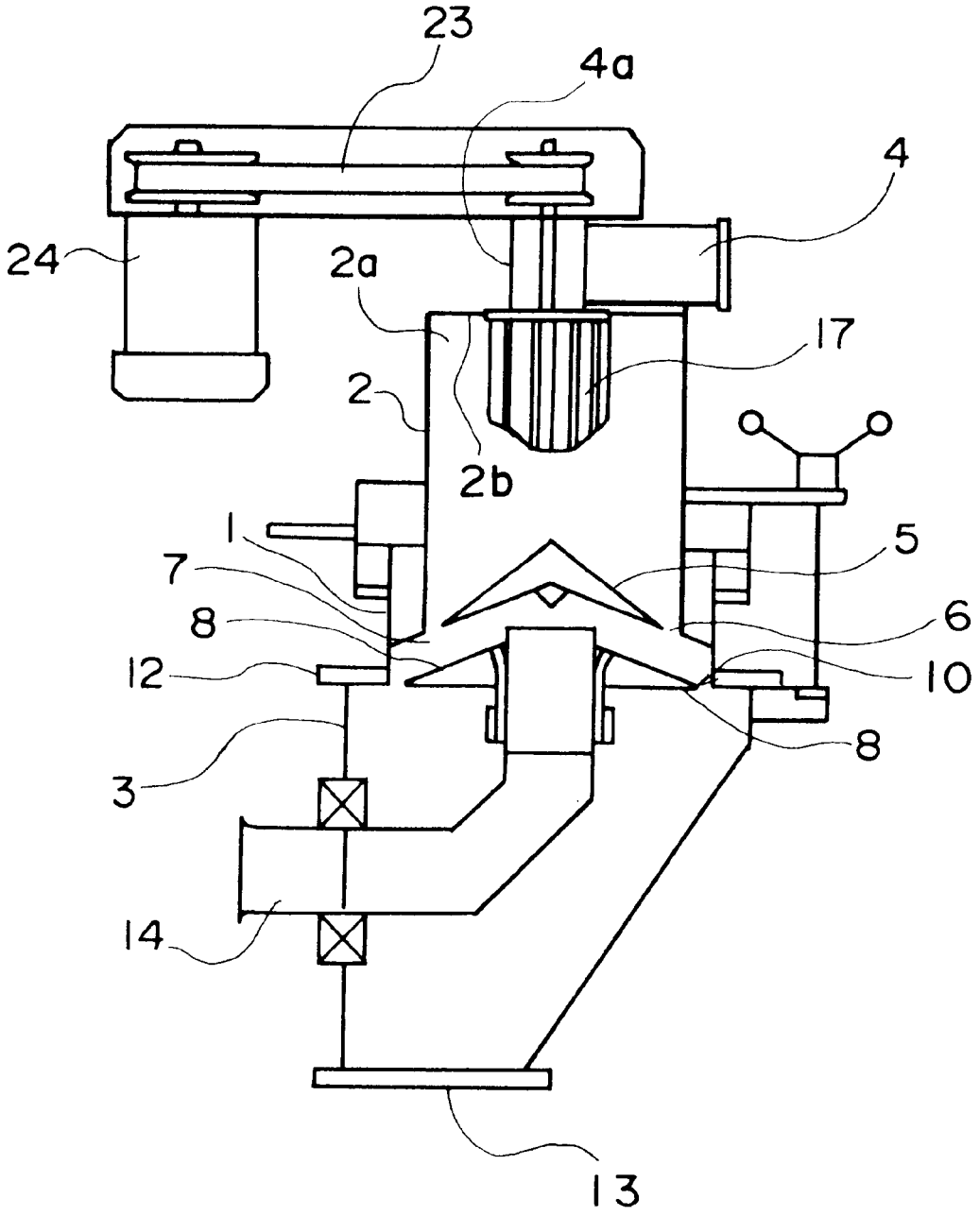
Figure 12:
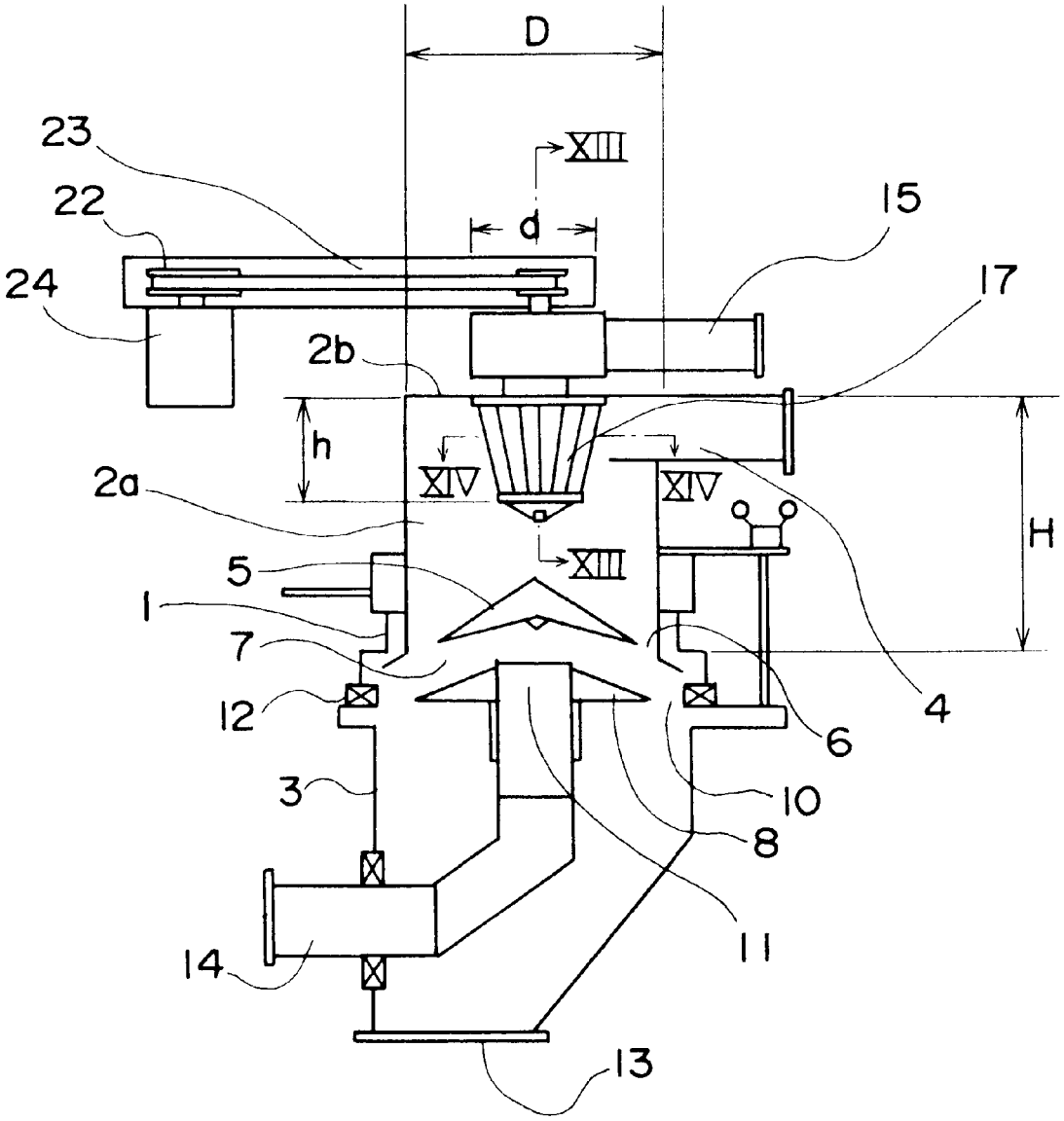
Figure 13:
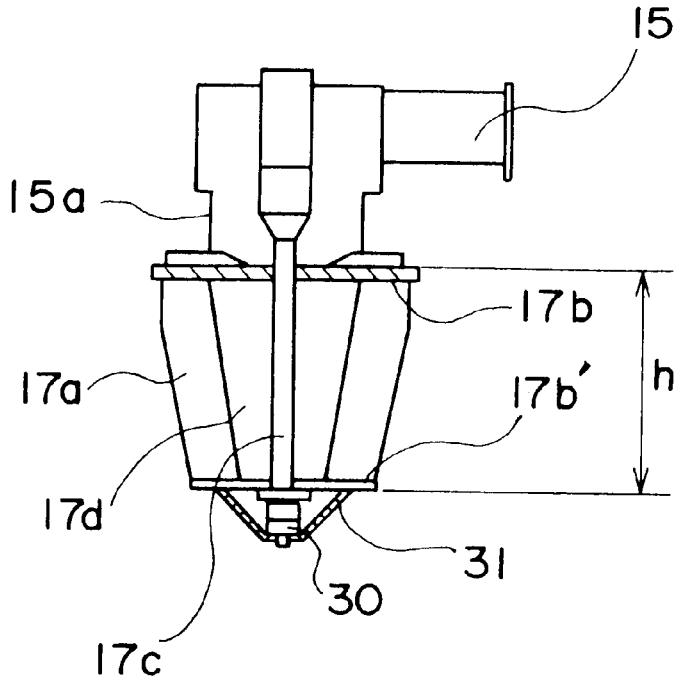
Figure 14:
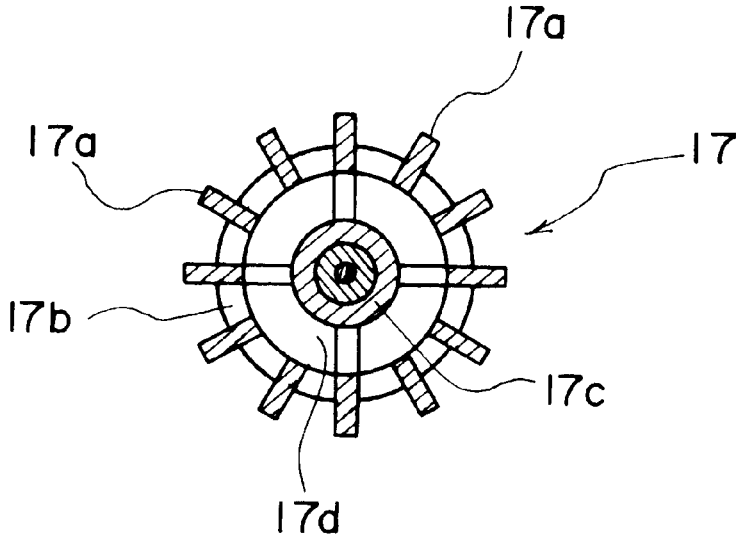
Figure 15:
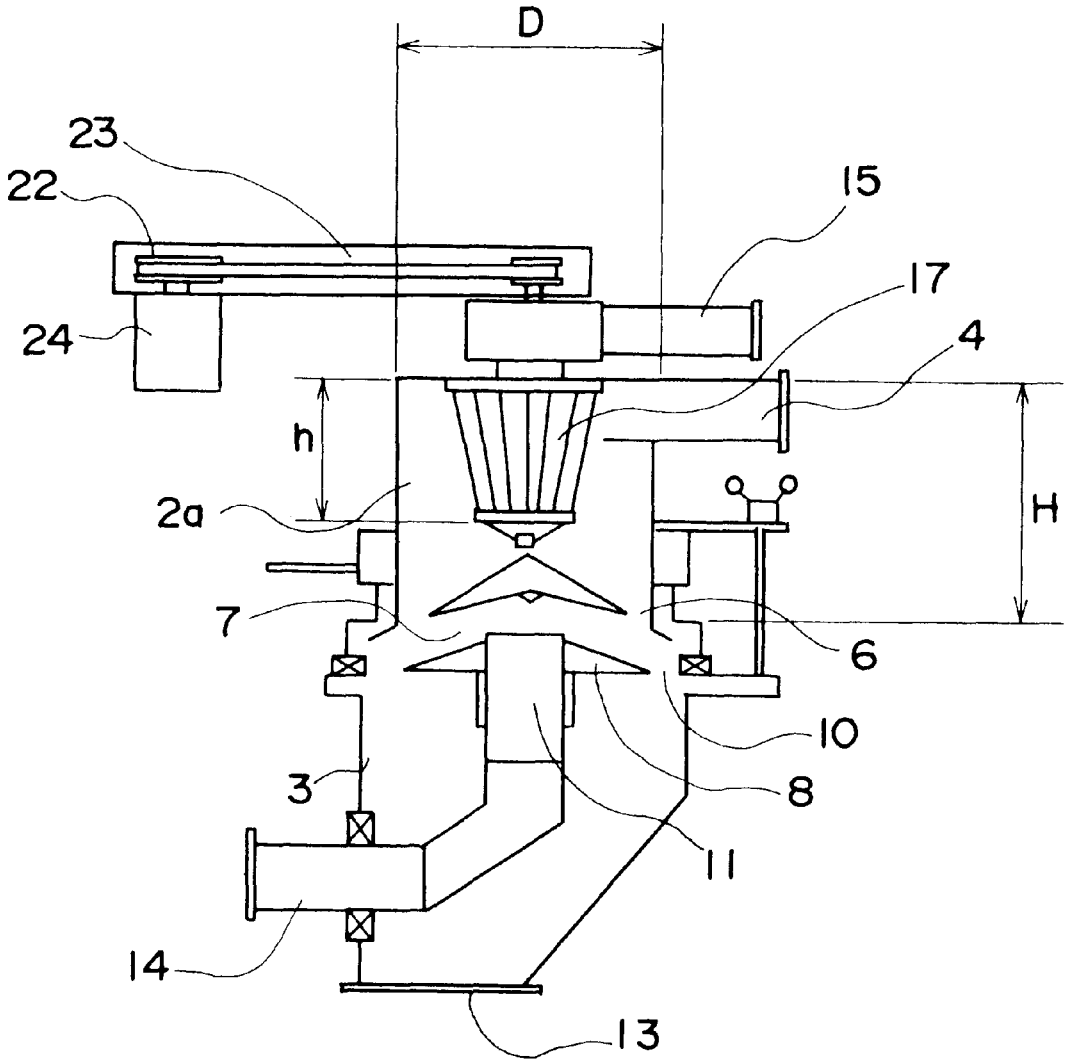
Figure 16:
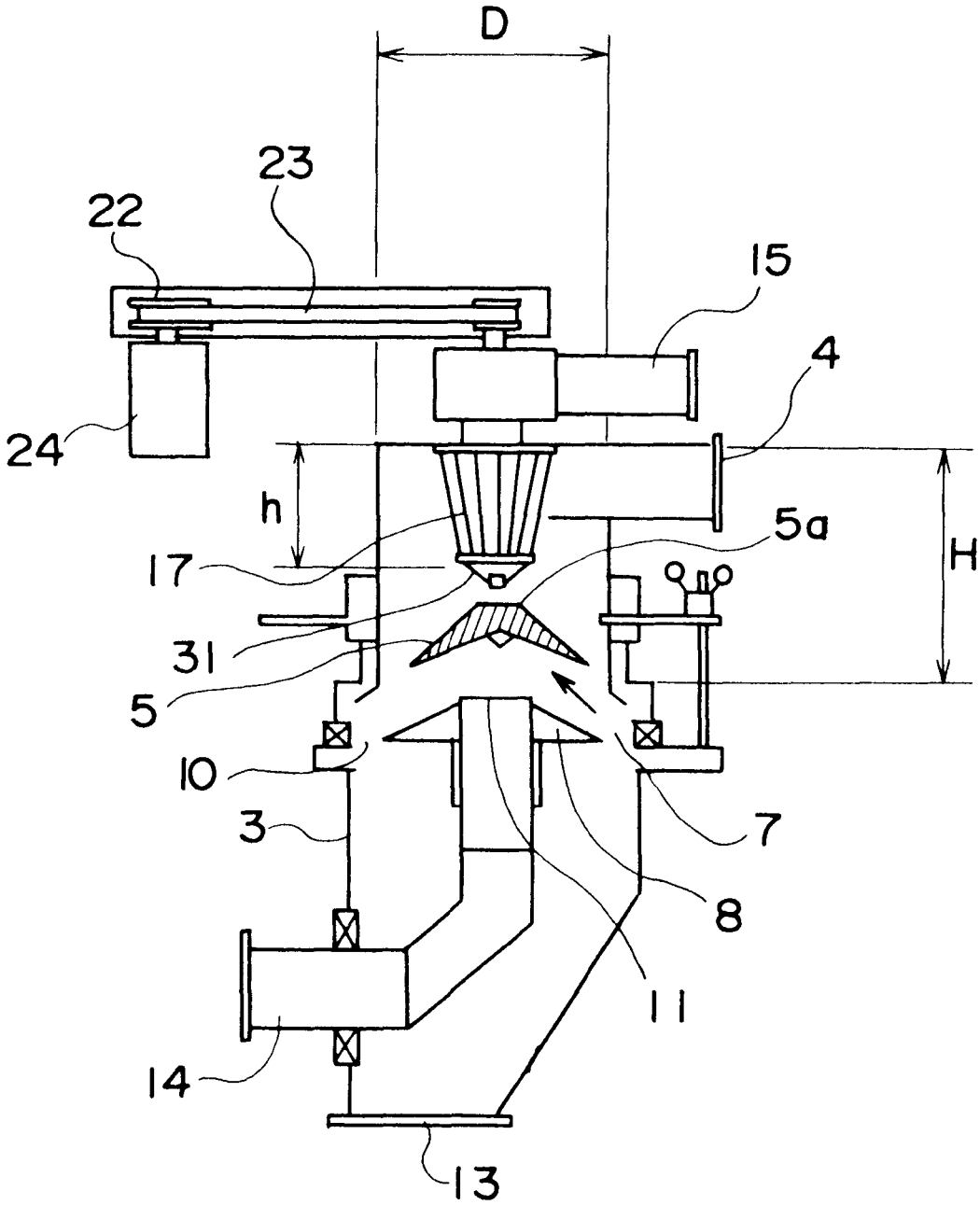
Figure 17:
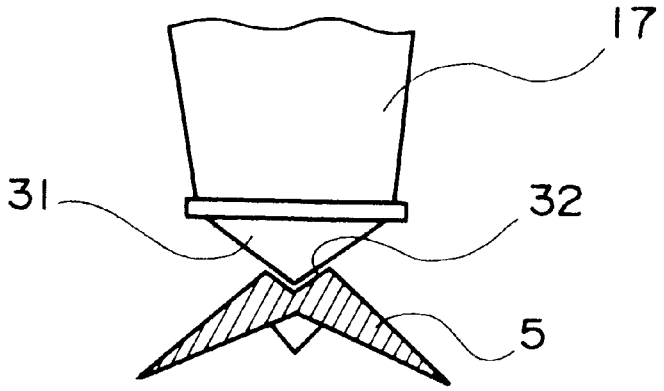
Figure 18:
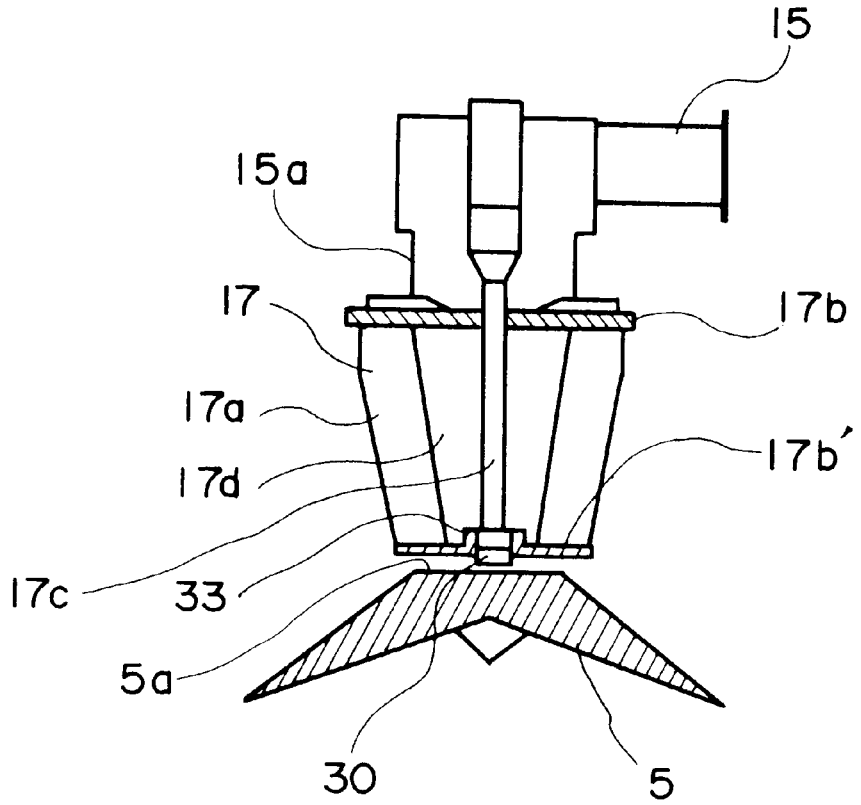
Figure 19:
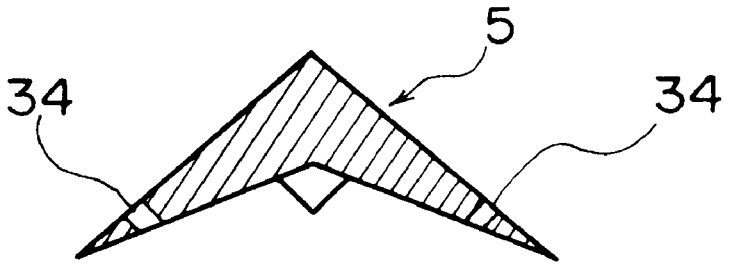
Figure 20:
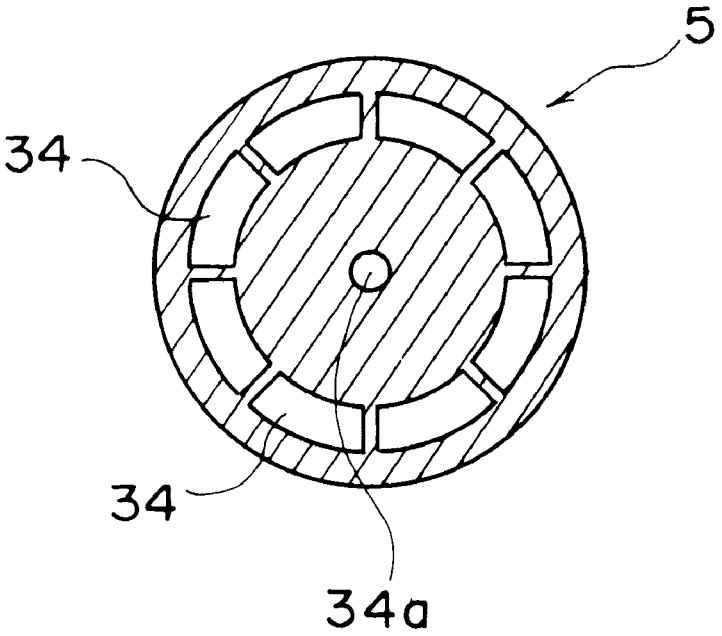
Figure 21A:
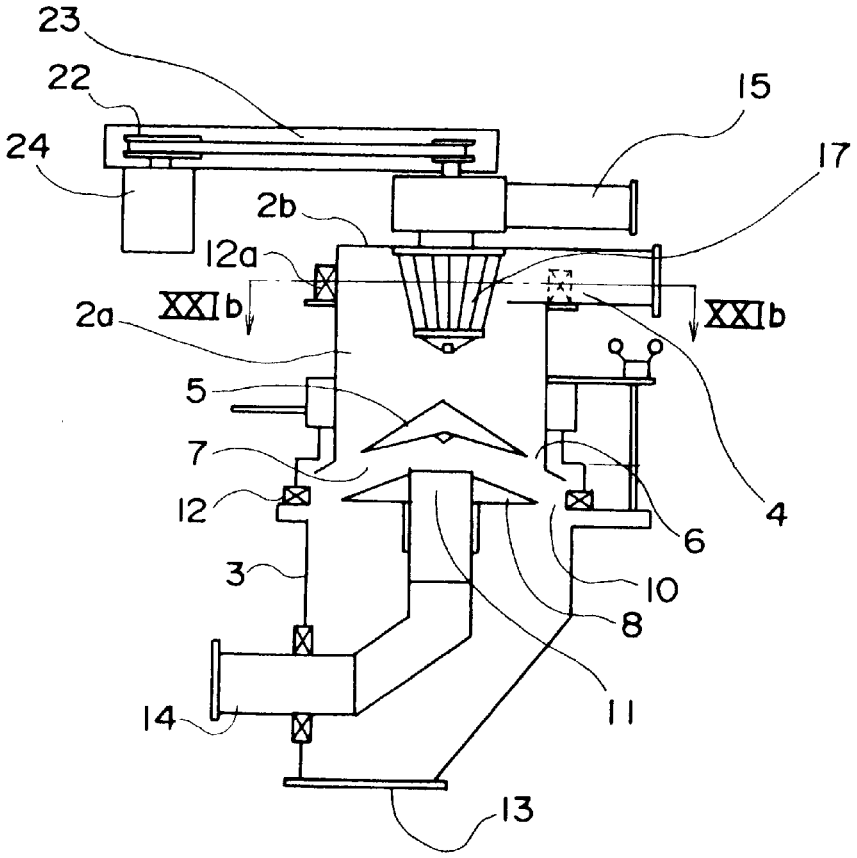
Figure 21B:
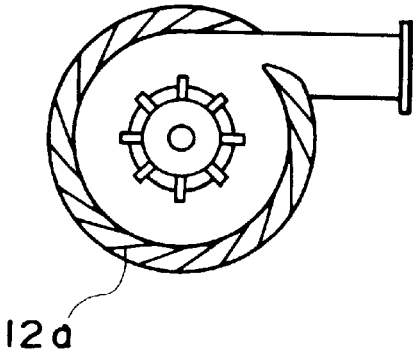
Figure 22A:
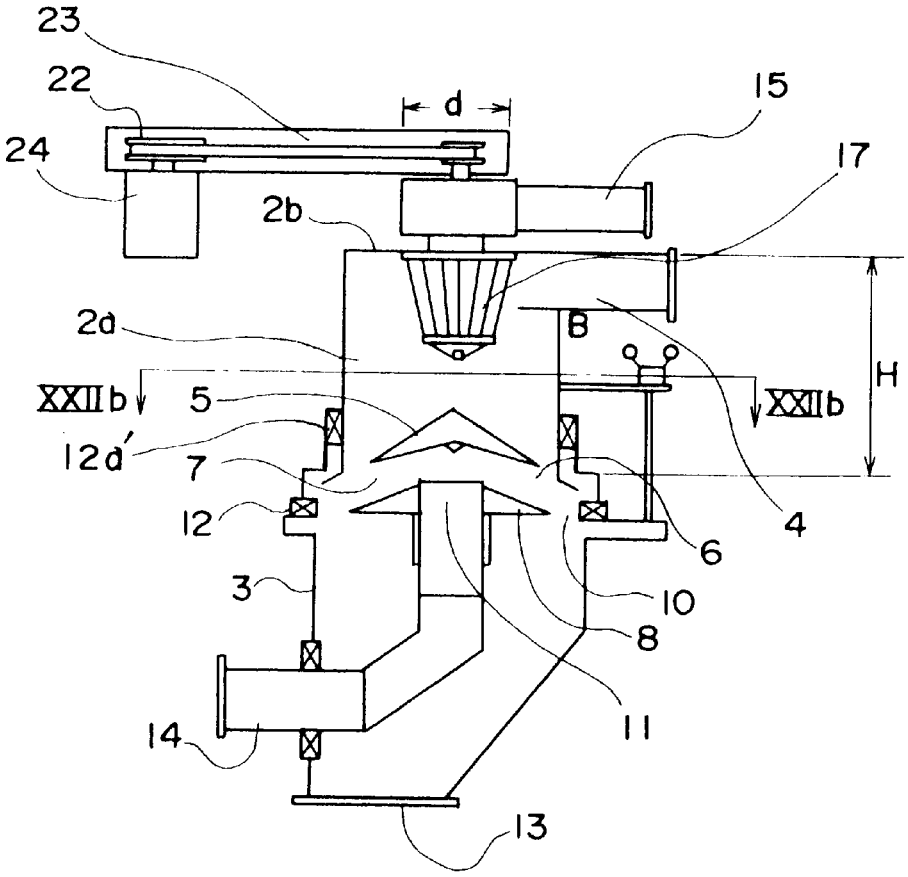
Figure 22B:
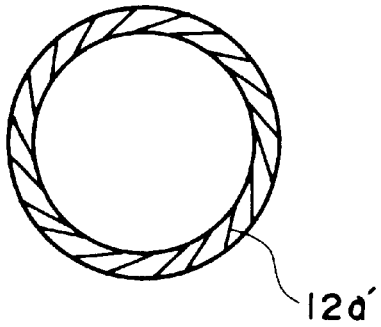
Figure 23:
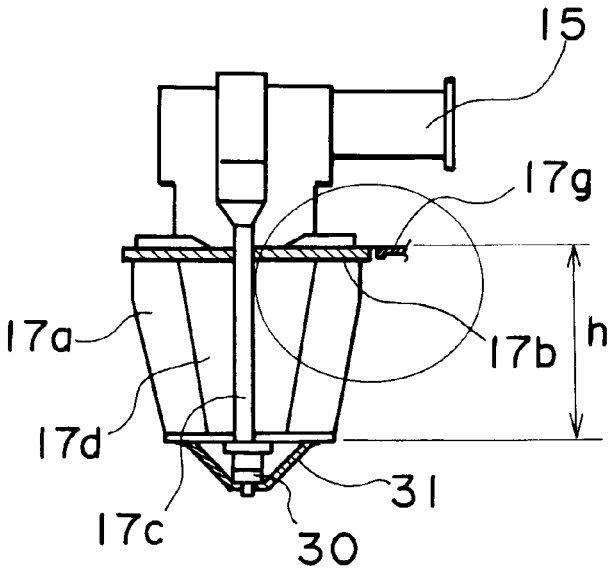
Figure 24:
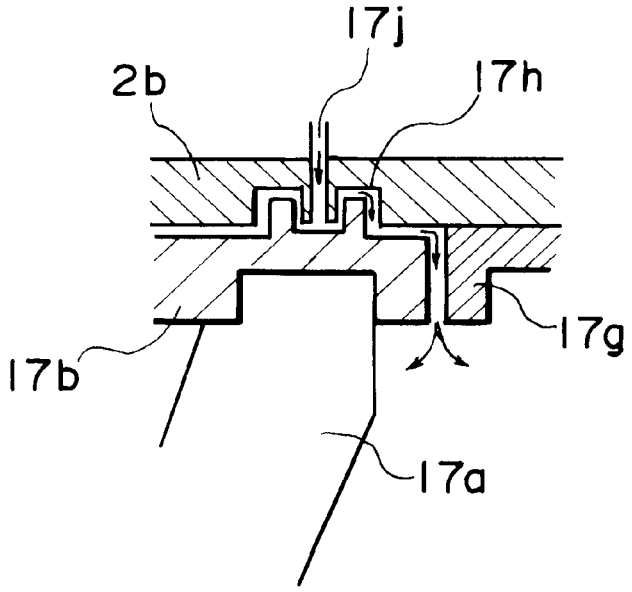

FIG. 7 is an elevational, cross-sectional view, similar to FIG. 2, diagrammatically showing a further embodiment of a classifying device according to the present invention;

FIG. 8 is a fragmentary view, similar to FIG. 4, showing a further example of a rotor structure;

FIG. 9 is an elevational, cross-sectional view, similar to FIG. 2, diagrammatically showing a further embodiment of a classifying device according to the present invention;

FIG. 10 is an elevational, cross-sectional view, similar to FIG. 2, diagrammatically showing a further embodiment of a classifying device according to the present invention;

FIG. 11 is an elevational, cross-sectional view, similar to FIG. 2, diagrammatically showing a further embodiment of a classifying device according to the present invention;

FIG. 12 is an elevational, cross-sectional view, similar to FIG. 2, diagrammatically showing a further embodiment of a classifying device according to the present invention;

FIG. 13 is an enlarged sectional view taken along the line XIII—XIII in FIG. 12;

FIG. 14 is an enlarged sectional view taken along the line XIV—XIV in FIG. 12;

FIG. 15 is an elevational, cross-sectional view, similar to FIG. 2, diagrammatically showing a further embodiment of classifying device according to the present invention;

FIG. 16 is an elevational, cross-sectional view, similar to FIG. 2, diagrammatically showing a further embodiment of a classifying device according to the present invention;

FIG. 17 is a fragmentary, elevational, cross-sectional view schematically showing an arrangement of a rotor and a center core of a further embodiment of a classifying device according to the present invention;

FIG. 18 is a fragmentary, elevational, cross-sectional view schematically showing an arrangement of a rotor and a center core of a further embodiment of a classifying device according to the present invention;

FIG. 19 is an elevational, cross-sectional view schematically showing a center core of a further embodiment of a classifying device according to the present invention;

FIG. 20 is a plan view of the center core of FIG. 19;

FIG. 21(*a*) is an elevational, cross-sectional view, similar to FIG. 2, diagrammatically showing a further embodiment of a classifying device according to the present invention;

FIG. 21(*b*) is an enlarged sectional view taken along the line XXIb—XXIb in FIG. 21(*a*);

FIG. 22(*a*) is an elevational, cross-sectional view, similar to FIG. 2, diagrammatically showing a further embodiment of a classifying device according to the present invention;

FIG. 22(*b*) is an enlarged sectional view taken along the line XXIIb—XXIIb in FIG. 22(*a*);

FIG. 23 is an elevational cross-sectional view, similar to FIG. 13, schematically showing a further embodiment of a rotor structure; and FIG. 24 is an enlarged view of an encircled portion in FIG. 23.

DETAILED DESCRIPTION OF THE PREFERRED EMBODIMENTS OF THE INVENTION

Referring now to FIG. 2, a classifying device according to the present invention has an upper, cylindrical housing 2 disposed in substantially vertical position and defining therewithin a dispersing chamber 2*a*. A feed port 4 is connected to an upper part of the upper housing 2 for feeding a jet stream comprising the solid particles and a carrier gas such as air is not the dispersing chamber 2*a*. The feed port 4 is oriented in the direction tangential to the inside periphery of the upper cylindrical housing 2 so that the jet stream forms a swirl in the dispersing chamber 2*a*.

A core plate member 5 is coaxially disposed within the dispersing chamber 2*a* to define an annular gap 6 between the inside periphery of the cylindrical housing 2 and the core plate member 5.

Connected to the bottom of the upper housing 2 is a lower housing 3 having a cylindrical section 1 coaxial with the upper housing 2 and defining therewithin a classifying chamber 7. Thus, the classifying chamber 7 is in fluid communication with the dispersing chamber 2*a* through the annular gap 6. The lower housing 3 has a lower section defining a collecting chamber (or hopper) 3*a* which is connected to the classifying chamber 7 and which has a discharge port 13.

A pipe member 14 having one end located outside the lower housing 3 for connection to evacuating means (not shown) through a dust collector such as a cyclone (not shown), extends into the lower housing 3 and terminates at the other end in the classifying chamber 7 to provide a fine powder exhaust port 11 coaxial with the cylindrical section 1.

An annular, tapered plate member 8 extends radially outward and obliquely downward from the periphery of the fine powder exhaust port 11 and terminates to form an annular space 10 between the inside periphery of the cylindrical section 1 and the outer periphery of the tapered plate member 8, so that the classifying chamber 7 is in fluid communication with the collecting chamber 3*a* through the annular space 10.

Vanes 12 are provided in a lower periphery of the cylindrical section 1 of the lower housing 3. As shown in FIG. 3(*b*), the vanes 12 are arranged to surround the tapered plate member 8 and are oriented so that air is fed to the classifying chamber 7 in the direction tangential to the inside periphery of the cylindrical section 1 to form a vortex flow when the classifying chamber 7 is evacuated by the evacuating means connected to the pipe member 14. The suction force also serves to urge the solid particles dispersed on the periphery of the core plate 5 to enter the classifying chamber 7. Thus, the solid particles form a vortex flow in the classifying chamber 7, which vortex flow is directed inward because of the suction force. Since the annular plate member 8 is in a conical shape, particles with the same diameter are located on the same radius position on the annular plate. Thus, solid particles having diameters greater than a specific borderline diameter cannot move up to the fine powder exhaust port 11 and fall into the collecting chamber 3*a* through he annular space 10, since the centrifugal force acting thereon is greater than the suction force. On the other hand, solid particles having diameters smaller than the borderline diameter move radially inward and enter the fine powder exhaust port 11, since the suction force acting thereon is greater than the centrifugal force. In this manner, the solid particles are separated into relatively small particles discharged through the fine powder exhaust port 11 and relatively coarse particles collected in the collecting chamber 3*a*through the annular space 10.

The most important feature of the present invention resides in that a rotor 17 is disposed within the dispersing chamber 2*a*. As shown in FIG. 3(*a*), the rotor 17 has a rotatable shaft 17*c* vertically and coaxially disposed within the cylindrical housing 2, a supporting ring 17*b* secured to the shaft 17*c* and a plurality of blades 17*a* secured to the supporting ring 17*b* for rotation therewith. As shown in FIG. 2, the rotatable shaft 17*c* extends through a top wall 2*b* of the cylindrical housing 2 and is driven by a motor 24 through a transmission mechanism including a pair of pulleys 22 and an endless belt 23.

As a result of the above construction, upon the rotation of the motor 24, the rotor 17 is rotated to form a vortex in the dispersing chamber 2*a*. The rotational speed of the motor 24 is preferably controlled with a controller 25 according to the particle size of the solid particles to be classified. It is preferred that the rotational speed of the motor is so controlled that the peripheral velocity of the rotor (at the outer edge of the blades 17*a*) is within the range of from 10 to 130 m/sec.

As shown in FIG. 3(*a*), the blades 17*a* are preferably angularly equally spaced apart from each other with an angle $\theta_1$ of 3–45 degrees, i.e. the number of the number of the blades is 8–120. The angle $\theta_1$ is determined in consideration of the peripheral velocity of the rotor 17, etc. The blades 17*a* are preferably detachably mounted on the ring 17*b* to permit the adjustment of the angle $\theta_1$.

In the embodiment shown, each of the blades 17*a* is supported by a pair of upper and lower supporting rings 17*b* and 17*b*' both of which are fixed to the rotatable shaft 17*c* as shown in FIG. 4. The blade 17*a* preferably has a lower portion bent or curved inward so that the outer diameter d (FIG. 2) of the rotor is gradually reduced in the lower portion thereof. The shape of the outer edge of the blade 17*a* may be angular (FIG. 4) or curved (FIG. 5).

The diameter d of the rotor 17 is preferably such that the ratio of the inside diameter D (FIG. 2) of the dispersion chamber 2*a* to the outer diameter d of the rotor 17 is in the range of from 1.1:1 to 3:1 for reasons of optimum vortex formation.

It is preferred tat each of the blades 17*a* have a surface of an anti-abrasion material for reasons of long service life thereof. The entire blade 17*a* may be formed of such an anti-abrasion material or an anti-abrasion coating may be applied only on the operating surface thereof, Examples of the anti-abrasion material include alumina, ceramics, nitrified materials and hard alloys.

With the above-described air flow-type classifier according to the present invention, the jet stream containing solid particles and a carrier gas is continuously fed through the feed port 4 to the dispersing chamber 2*a* and swirls in the chamber 2*a* by the force of inertia as well as the rotational force given by the rotor 17, so that the solid particles are classified by the centrifugal force with the aid of the core plate 5. Thus, fine particles are radially inwardly shifted in the dispersing chamber 2*a*, while coarse particles are shifted toward the periphery of the chamber 2*a*, so that solid particles having particle sizes greater than a specific value gather near the inside peripheral wall of the chamber 2*a*.

In this case, when the jet stream contains aggregates of solid particles containing fine particles, which have been formed due to van der Waals force, static electricity, etc., the vortex formed by the rotation of the rotor 17 can break the aggregates. Namely, the vortex creates free vortex and semi-free vortex in the dispersion chamber 2*a*, so that there is formed a difference in peripheral velocity along the radial direction. This difference in peripheral velocity creates a shearing force and the shearing force acts on the aggregates and destroys the aggregates.

The relatively large particle size particles gathered along the inside periphery of the dispersing chamber 2*a* are then passed through the annular gap 6 to the classifying chamber 7 due to the suction force of the evacuating means connected to the pipe member 14. The particles are then formed into a vortex flow due to the air stream introduced through the vanes 12 into the classifying chamber 7 in the tangential direction by the suction force of the evacuating means. Thus, the particles are subjected to so-called dry centrifugal classification, so that relatively coarse particles are shifted radially outward and enter the collecting chamber 3*a* through the annular space 10. Relatively fine particles, on the other hand, are shifted radially inward and enter the fine powder exhaust port 11 and are discharged through the pipe member 14.

Thus, with the above-described air flow-type classifier according to the present invention, aggregates of particles are prevented from entering the classifying chamber 7 because of the action of the rotor 17 in the dispersing chamber 2*a*. Further, since the solid particles introduced into the classifying chamber 7 have been once subjected to classification in the dispersing chamber 2*a*, the final product collected in the collecting chamber 3*a* has improved narrower particle size distribution.

The above embodiment may be modified in various manners. These modifications will be next described. In the following embodiments, component parts similar to those of the above embodiment are designated by the same reference numerals.

Referring to FIG. 6, rotor blades 17*a* are each adjustable within an angle $\theta_2$ of 15–90 degrees with respect to the rotational direction thereof. By the adjustment of the angle $\theta_2$, the optimum vortex can be formed in the dispersing chamber according to the solid particles to be treated.

In the embodiment shown in FIG. 7, the top plate 2*b* of the upper housing 2 has a center opening to which a pipe 15*a* is connected. To the pipe 15*a* is further connected an air exhaust pipe 15 for discharging part of air from the dispersing chamber 2*a*. The exhaust pipe 15 is connected to a blower (not shown) through a flow control valve 16. Thus, the inside of the rotor 17 is evacuated by the blower and the evacuation force is controlled by the valve 16.

Because of the evacuation through the air exhaust pipe 15, there is created a centripetal force. Thus, aggregates introduced into the dispersing chamber 2*a* are subjected to both the centripetal force and the centrifugal force and are broken more intensively as compared with the above embodiment.

In the embodiment shown in FIG. 8, each of the blades 17*a* has a coating of a old releasing material such as a silicone resin or a fluorocarbon resin. Thus, toner particles are prevented form depositing on the rotor blades 17*a*.

In the embodiment shown in FIG. 9, the rotor 17 is so arranged that the vertical position of the blades 17*a* is adjustable. Thus, optimum vortex flow can be established by adjusting the portion of the blades 17*a*. The adjustment can be performed by, for example, the adjustment of the position of the supporting ring 17*b* relative to the center rotational shaft 17*c*.

In the embodiment shown in FIG. 10, the top plate 2*b* of the upper cylindrical housing 2 to which the rotor 17 is secured is hinged so that the dispersing chamber is opened and closed by displacing the top plate 2*b*. Thus, the inside of the dispersing chamber 2*a* as well as the rotor 17 can be easily inspected for cleaning and maintenance.

In the embodiment shown in FIG. 11, the top plate 2*b* of the upper housing 2 has a center opening to which the feed port means 4 for supplying the solid particles at the dispersing chamber 2*a* together with the carrier gas through the rotor 17. The solid particles and the carrier gas supplied to the opening are discharged into the dispersing chamber 2*a* through the space between respective blades 17*a*and form a vortex by rotation of the blades 17*a*. Thus, not only the above-described shearing force created by the vortex but also impact force by the blades 17*a* are acted on the solid particles. Therefore, breakage of aggregated solid particles is accelerated.

The embodiment shown in FIGS. 12–14 differs from the embodiment shown in FIG. 7 in structure of the rotor 17. As shown in FIGS. 13 and 14, rotor blades 17*a* are angularly equally spaced apart from each other and are secured between a pair of upper and lower supporting rings 17*b* and 17*b*'. Designed as 15 is an air exhaust pipe. Air in the dispersing chamber 2*a* is passed through the space between the blades 17*a* and the inside space 17*d* in the rotor and is discharged through the exhaust pipe 15. The upper and lower supporting rings 17*b* and 17*b*' are fixedly secured to the central shaft 17*c* coaxially disposed in the chamber 2*a*. The shaft 17*c* extends through the top plate 2*b* of the upper housing 2 and operatively connected to a motor 24 through a mechanism including pulleys 22 and an endless belt 23.

As shown in FIG. 13, a fixing member such as a nut 30 is provided for securing the lower supporting ring 17*b* to the shaft 17*c*. Similar supporting member is also provided to secure the upper supporting ring 17*b* to the shaft 17*c*. Designated as 31 is a cap for covering the underside of the lower supporting ring 17*b*' together with the fixing member 30. The cap 31 is in a frustoconical shape so that classification of the solid particles can be effected in the space defined between the cap 31 and the core plate 5. Namely, since the space between the cap 31 and the core plate 5 decreases in the radical inward direction, centrifugal classification occurs in this area. Further, centrifugal classification also occurs in the annular space between the top ceiling 2*b* of the dispersing chamber 2*b* and the upper surface of the core plate 5.

It is preferred that a plurality of rotors 17 having different vertical height h be provided for selective use. FIG. 15 illustrate a state in which the rotor 17*b* in FIG. 12 is replaced by a taller rotor. It is also preferred that the ratio of the height H of the dispersing chamber 2*a* to the height h of the rotor 17 be in the range of 1:0.1 to 1:0.9, more preferably 1:0.25 to 1:0.9

In the embodiment shown in FIG. 16, the conical core plate 5 in FIG. 12 is cut at its upper portion to form a flat top surface 5*a*. In this embodiment, too, since the space between the cap 31 and the core plate 5 decreases in the radical inward direction, centrifugal classification occurs in this area. Further, since the space between the cap 31 and the core plate 5 is so narrow that no flow stagnation occurs in this area.

In the embodiment shown in FIG. 17, the conical core plate 5 in FIG. 12 is cut at its upper portion to form a V-shaped concave surface 32. In this embodiment, too, since the space between the cap 31 and the core plate 5 decreases in the radial inward direction, centrifugal classification occurs in this area. Further, since the space between the cap 31 and the concave portion 32 is so narrow that no flow stagnation occurs in this area.

In the embodiment shown in FIG. 18, the cap 31 in FIG. 13 is not used. To prevent the fixing member 30 from protruding from the underside of the rotor 17, a receiving section having a large thickness is provided for engagement with the fixing member 30. Thus, the fixing member 30 can be fitted into the receiving section 33 in flush with the underside of the rotor 17. In close to the flat underside of the rotor 17 is disposed the core plate 5. The conical core plate 5 (such as shown in FIG. 12) is cut at its upper portion to form a flat top surface 5*a*having nearly the same diameter with that of the underside of the rotor 17. The distance between the lower surface of the rotor 17 and the top surface 5*a* of the core plate 5 is 7 mm or less so that no flow stagnation occurs in this area.

In the embodiment shown in FIGS. 19 and 20, the core plate 5 has one or more openings 34 so that the dispersing chamber 2*a* is in fluid communication with the classifying chamber 7 not only through the annular gap 6 but also through each of the openings 34. The openings 34 in the illustrated embodiment are in the form of slits or slots arranged in a circle. Each slit 34 preferably has a width (radial direction) of 1–10 mm, more preferably 3–5 mm. As a consequence of the provision of the openings 34, the solid particles in the dispersing chamber 2*a* are passed to the classifying chamber 7 not only through the annular gap 6 but also through each of the openings 34. Therefore, the coarse particles gathering the in the periphery of the dispersing chamber 2*a* are passed to the classifying chamber 7 in an expediated manner, so that the in situ formation of aggregates in the dispersing chamber 7 is prevented. Moreover, the openings 34 can reduce the velocity of air flowing form the dispersing chamber 2*a* to the classifying chamber 7, so that the classification in the classifying chamber is smoothly performed without adverse affection by the air flow.

It is preferred that a center opening 34*a* be provided at a central portion of the core plate 5. In this case, the center opening 34*a*is located at a position adjacent to the fine powder exhaust port 11, the fine particles separated in the dispersing chamber can be passed directly to the fine powder exhaust port 11 and, therefore the separation efficiency of the classifying device is improved.

In the embodiment shown in FIGS. 21(*a*) and 21(*b*), vanes 12*a* are provided in the periphery of a side wall of the upper housing 2 for introducing compressed air into the dispersing chamber. The orientation angle of each of the vanes 12*a* is preferably made adjustable. The vanes 12*a* can form a uniform vortex in the dispersing chamber 2*a*. Therefore, the solid particles are subjected to both centrifugal force and an influence of the air flow toward the center of the rotor and are accelerated to effect the dispersion and classification.

In the embodiment shown in FIGS. 22(*a*) and 22(*b*), vanes 12*a*' similar to those shown in FIGS. 21(*a*) and 21(*b*) are provided such that the position thereof is vertically adjustable. Thus, vortex is established in the dispersing chamber in the optimum state to effect the dispersion and classification.

FIGS. 23 and 24 illustrate an embodiment in which the structure of the embodiment shown in FIG. 12 is modified and in which a compressed air inlet port 17*j* is provided in a top wall 2*b* of the upper housing 2 for jetting compressed air on circumference of the rotor 17. A concave portion 17*h* is formed on the inside wall of the top plate 2*b* and the upper supporting ring 17*b* is provided with protruded portions loosely fitted in the concave portion 17*h* to difine a labyrinth therebetween. The inlet port 17*j* is provided in the concave portion 17*h* of the top plate 2*b*. An annular plate 17*g* is provided to surround the upper supporting ring 17*b* so that the compressed air fed through the inlet port 17*j* can flow down along the circumference of the rotor blades 17*a*. As a consequence of the above structure, solid particles swirling in the dispersing chamber 2*a* are prevented from entering the inside space of the rotor 17 through the space between respective blades 17*a*.

The following examples will further illustrate the present invention.

EXAMPLE 1

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIGS. 2 and 3 at 60 m/sec of a peripheral velocity of the rotor to obtain toner having a weight average particle diameter of 7.3 μm and a super-fine particle content of 13.0% (the term "super-fine particle content" used herein and hereinafter is intended to refer to a percentage of the number of the super-fine particles having a diameter of 4 μm or less based on the total number of the toner particles). The yield was 80.0% (the term "yield" used herein and hereinafter is intended to refer to a weight percentage of the toner product based on the finely divided product charged in the classifier).

EXAMPLE 2

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIGS. 2 and 3 at 50 m/sec of a peripheral velocity of the rotor to obtain toner having a weight average particle diameter of 7.35 μm and a super-fine particle content of 10.0% with a yield of 79.0%. The above procedure was repeated in the same manner as described except that the peripheral velocity of the rotor was changed to 70 m/sec, thereby obtaining toner having a weight average particle diameter of 7.25 μm and a super-fine particle content of 16.0% with a yield of 79.5%.

EXAMPLE 3

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIGS. 2 and 3 and having 24 angularly equally spaced apart blades under the same condition as that in Example 1 to obtain toner having a weight average particle diameter of 7.28 μm a super-fine particle content of 10.0% with a yield of 82.0%.

EXAMPLE 4

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIGS. 2 and 4 under the same condition as that in Example 3 to obtain toner having a weight average particle diameter of 7.30 μm and a super-fine particle content of 9.0% with a yield of 82.0%. Each of the blades provided on the rotor had an area ratio of the upper section to the lower section of 3:2.

EXAMPLE 5

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIGS. 2 and 4 under the same condition as that in Example 4 to obtain toner having a weight average particle diameter of 7.20 μm and super-fine particle content of 8.0% with a yield of 82.0%. The orientation angle $\theta_2$ of each of the blades was 70 degrees.

EXAMPLE 6

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIG. 2 under the same condition as that in Example 1 to obtain toner having a weight average particle diameter of 7.30 μm and a super-fine particle content of 11.0% with a yield of 80.5%. The ratio of the outer diameter of the rotor 17 to the inside diameter of the dispersion chamber 2*a* was 2:3.

EXAMPLE 7

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIG. 7 at 70 m/sec of a peripheral velocity of the rotor to obtain toner having a weight average particle diameter of 7.25 μm and an super-fine particle content of 8.0% with a yield of 82.5%. The ratio of the discharged air flow rate through the rotor 17 to that through the fine powder exhaust port 11 was 4:5.

EXAMPLE 8

A mixture containing 75% by weight of a styrene-acrylic acid copolymer, 10% by weight of magnetic powder, 3% by weight of a charge controlling agent and 12% by weight of carbon black was kneaded and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIG. 2 under the same condition as that in Example 1 to obtain toner having a weight average particle diameter of 7.45 μm and a super-fine particle content of 9.0%. The surface of each of the blades was coated with alumina (anti-abrasion agent). The classification was continued for 1,000 hours. Throughout the operation, a yield of 80.5% was obtained in a stable manner. No abrasion was found in the surfaces of the blades.

EXAMPLE 9

A mixture containing 80% by weight of a styrene-acrylic acid copolymer, 5% by weight of carnauba wax, 3% by weight of a charge controlling agent and 12% by weight of carbon black was kneaded and extruded through a die to form a plate. After solidification, the plate was crushed with a hammer and then pulverized with a jet mill to obtain finely divided product having a weight average particle diameter of 7.5 μm. This product was then classified with an air flow-type classifier as shown in FIG. 2 under the same condition as that in Example 1 to obtain toner having a weight average particle diameter of 7.85 μm and a super-fine particle content of 12.0%. The surface of each of the blades was coated with tetrafluoroethylene (FIG. 8). The classification was continued for 1,000 hours. Throughout the operation, a yield of 85.5% was obtained in a stable manner. No deposition of toner was found on the surfaces of the blades.

EXAMPLE 10

A mixture containing 80% by weight of a styrene-acrylic acid copolymer, 5% by weight of carnauba wax, 3% by weight of a charge controlling agent and 12% by weight of carbon black was kneaded and extruded through a die to form a plate. After solidification, the plate was crushed with a hammer and then pulverized with a jet mill to obtain a finely divided product having a weight average particle diameter of 7.5 μm. This product was then classified with an air flow-type classifier as shown in FIG. 2 to obtain toner having a weight average particle diameter of 7.80 μm and a super-fine particle content of 13.0% with a yield of 85.5%. The lower end of the rotor was positioned at a level equal to ⅖ of the height of the dispersion chamber.

EXAMPLE 11

A mixture containing 80% by weight of a styrene-acrylic acid copolymer, 5% by weight of carnauba wax, 3% by weight of a charge controlling agent and 12% by weight of carbon black was kneaded and extruded through a die to form a plate. After solidification, the plate was crushed with a hammer and then pulverized with a jet mill to obtain a finely divided product having a weight average particle diameter of 7.5 μm. This product was then classified with an air flow-type classifier as shown in FIG. 11 to obtain toner having a weight average particle diameter of 7.80 μm and a super-fine particle content of 13.0% with a yield of 85.5%.

EXAMPLE 12

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIGS. 12–14 at 60 m/sec of a peripheral velocity of the rotor to obtain toner having a weight average particle diameter of 7.2 μm and a super-fine particle content of 16.0% with a yield of 82.0%. The ratio of the diameter d of the rotor 17 to the diameter D of the dispersion chamber was 2:3, while the ratio of the axial length h of the rotor 17 to the diameter D of the dispersion chamber was 4:5. The amount of air discharged through the rotor from the exhaust pipe 15 was 30% of the total amount of air discharged from the classifier.

EXAMPLE 13

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIGS. 12–14 at 60 m/sec of a peripheral velocity of the rotor to obtain toner having a weight average particle diameter of 7.2 μm and a super-fine particle content of 15.0% with a yield of 81.0%. The ratio of the diameter d of the rotor 17 to the diameter D of the dispersion chamber was 2:3, the ratio of the axial length h of the rotor 17 to the height H of the dispersion chamber was 7:5 and the ratio of the axial length h to the diameter d of the rotor was 3:5. The amount of air discharged through the rotor from the exhaust pipe 15 was 30% of the total amount of air discharged from the classifier.

EXAMPLE 14

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIG. 19 under the same condition as that in Example 13 to obtain toner having a weight average particle diameter of 7.18 μm and a super-fine particle content of 10.0% with a yield of 82.0%. The upper surface of the center core 5 had a conical shape.

Example 15

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIGS. 12 and 13 under the same condition as that in Example 13 to obtain toner having a weight average particle diameter of 7.20 μm and a super-fine particle content of 8.0% with a yield of 82.0%. The center core 5 was provided with slits as shown in FIGS. 19 and 20 at a position radially outwardly spaced apart from the center of the core 5 by 90% of the radius thereof. Each slit had a width (in the radial direction) of 5 mm.

EXAMPLE 16

A mixture containing 85% by weight of a styrene-acrylic acid copolymer, 3% by weight of a charge controlling agent and 12% by weight of carbon black was melt and extruded through a die to form a plate. After solidification, the plate was crushed with a hammer and then pulverized with a jet mill to obtain a finely divided product having a weight average particle diameter of 7.0 μm. This product was then classified with an air flow-type classifier as shown in FIGS. 12 and 13 under the same condition as that in Example 13 to obtain toner having a weight average particle diameter of 7.25 μm and a super-fine particle content of 9.0% with a yield of 82.0%. As shown in FIG. 18, a fixing member 30 was embedded within a supporting ring 17*b* of the rotor 17. The distance between the lower surface of the fixing member and the top surface of the center core was 5 mm.

EXAMPLE 17

Example 7 was repeated in the same manner as described except that an air flow-type classifier as shown in FIGS. 21(*a*) and 21(*b*) was substituted for that shown in FIG. 7 and that a half of the exhaust air discharged through the rotor 17 from the exhaust pipe 15 was recycled to vanes 12*a*, thereby obtaining toner having a weight average particle diameter of 7.25 μm and a super-fine particle content of 8.0% with a yield of 83.0%.

EXAMPLE 18

Example 7 was repeated in the same manner as described except that an air flow-type classifier as shown in FIGS. 22(*a*) and 22(*b*) was substituted for that shown in FIG. 7 and that a half of the exhaust air discharged through the rotor 17 from the exhaust pipe 15 was recycled to vanes 12*a*', thereby obtaining toner having a weight average particle diameter of 7.25 μm and a super-fine particle content of 8.0% with a yield of 83.5%. The vanes 12*a*' were located at a level equal to ⅔ of the height H of the dispersing chamber 2 from the top 2*b* thereof.

EXAMPLE 19

Example 7 was repeated in the same manner as described except that the air flow-type classifier shown in FIG. 7 was modified as shown in FIGS. 23 and 24. Thus, compressed air was fed through an inlet port 17*j* in an amount equal to 1/10 of the exhaust air discharged through the rotor 17 from the exhaust pipe 15 and uniformly jetted into the dispersing chamber 2. The process was continued for 500 hours, revealing that no toner particles are discharged from the exhaust pipe 15. The toner obtained had a weight average particle diameter of 7.25 μm and a super-fine particle content of 8.0% The yield was 82.5%.

Comparative Example

Figure 1:
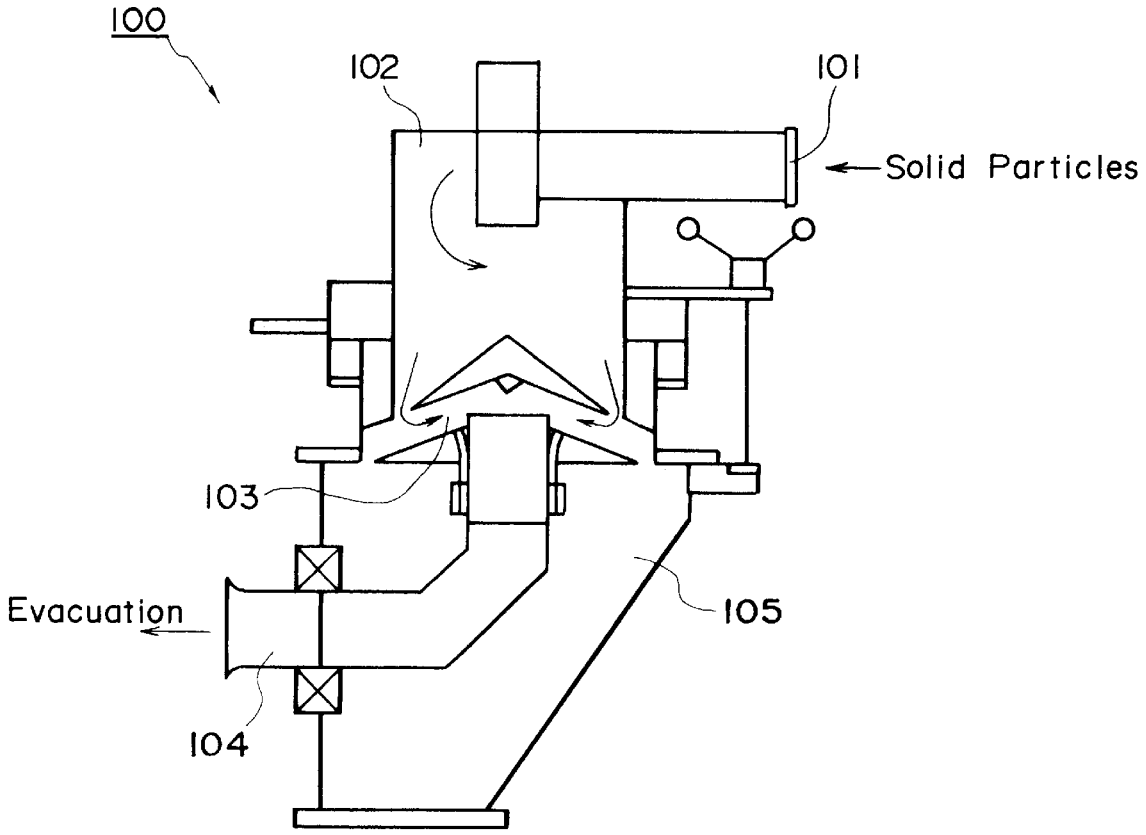
FIG. 1 Prior Art
FIG. 1 is an elevational, cross-sectional view diagrammatically showing a conventional classifying device.

Example 1 was repeated in the same manner as described except that an air flow-type classifier as shown in FIG. 1 without a rotor in the dispersing chamber 2 was used, thereby obtaining toner having a weight average particle diameter of 7.5 μm and a super-fine particle content of 14.0% with a yield of 75.0%.

The invention may be embodied in other specific forms without departing form the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A classifying device comprising an upper, dispersing chamber for dispersing solid particles supplied thereto together with a carrier gas, and a lower, classifying chamber directly connected to a lower end of said dispersing chamber for centrifugally classifying said solid particles, supplied from said dispersing chamber to said classifying chamber, into relatively fine particles and relatively coarse particles, said device being characterized in that said dispersing chamber is provided with a rotor for swirling said solid particles in said dispersing chamber; said device further comprising a core plate member disposed within said dispersing chamber at a position below said rotor to define an annular gap between said dispersing chamber and said core plate member so that said classifying chamber is in fluid communication with said dispersing chamber through said annular gap; wherein said rotor has an axis and a lower end and a cap covering said lower end thereof, said cap having a lower surface; and wherein the core plate member has a top surface and the distance between the lower surface of said cap and the top surface of said core plate member is decreased in a radially inward direction with respect to said rotor axis.

2. A classifying device as claimed in claim 1, further comprising means for controlling the revolution speed of said rotor.

3. A classifying device as claimed in claim 1, wherein said rotor comprises a rotatable shaft, and a plurality of angularly spaced apart blades detachably secured to said shaft for rotation therewith with said shaft as a center of rotation.

4. A classifying device as claimed in claim 3, wherein the number of said blades is 8–120 and wherein said blades are angularly equally spaced apart from each other.

5. A classifying device as claimed in claim 3, wherein the orientation of each of said blades is made adjustable and is within an angle of 15–90 degrees with respect to the rotational direction thereof.

6. A classifying device as claimed in claim 3, wherein each of said blades has a surface of an anti-abrasion material.

7. A classifying device as claimed in claim 3, wherein each of said blades has a surface of a mold releasing material.

8. A classifying device as claimed in claim 3, wherein said rotor is so arranged that the vertical position of said blades is made adjustable.

9. A classifying device as claimed in claim 1, wherein said dispersion chamber has an inside diameter, said rotor has an outer diameter, and the ratio of the inside diameter of said dispersion chamber to the outer diameter of said rotor is in the range of 1.1:1 to 3:1.

10. A classifying device as claimed in claim 1, further comprising an air exhaust pipe connected to a top of said dispersing chamber at a position adjacent said rotor for discharging portions of air from said dispersing chamber.

11. A classifying device as claimed in claim 10, further comprising an air inlet port provided in a top wall of said dispersing chamber for jetting compressed air on a circumference of said rotor.

12. A classifying device as claimed in claim 1, further comprising feed port means connected to a top of said dispersing chamber at a position adjacent said rotor for supplying said solid particles to said dispersing chamber together with said carrier gas through said rotor.

13. A classifying device as claimed in claim 1, wherein the rotor and the dispersing chamber each have a height, and the ratio of the height of said dispersing chamber to the height of said rotor is 1:0.1 to 1:0.9.

14. A classifying device as claimed in claim 13, wherein said rotor is detachably disposed in said dispersing chamber.

15. A classifying device as claimed in claim 1, wherein the rotor and the dispersing chamber each have a height, and the ratio of the height of said rotor to the height of said dispersing chamber is 1.1:1 to 4:1.

16. A classifying device as claimed in claim 1, wherein said dispersing chamber has a hinged top wall so that said dispersing chamber is opened and closed with said top wall, and wherein said rotor is secured to said top wall and is taken out of said dispersion chamber when said top wall is opened.

17. A classifying device as claimed in claim 1, wherein said core plate member is secured within said dispersing chamber such that the position thereof is vertically adjustable.

18. A classifying device as claimed in claim 1, wherein said dispersing chamber has a ceiling, and the distance between the ceiling of said dispersing chamber and the top surface of said core plate member is decreased in said radially inward direction.

19. A classifying device as claimed in claim 18, wherein said ceiling of said dispersing chamber is horizontal and the top surface of said core plate member is conical.

20. A classifying device as claimed in claim 1, further comprising vanes provided in a periphery of a side wall of said dispersing chamber for introducing air into said dispersing chamber.

21. A classifying device as claimed in claim 1, further comprising vanes provided in a periphery of a side wall of said dispersing chamber for introducing air into said dispersing chamber, the position of said vanes being vertically adjustable.

22. A classifying device as claimed in claim 1, wherein said rotor has a lower surface, and the lower surface of said rotor is located adjacent to the top surface of said core plate member.

23. A classifying device as claimed in claim 22, wherein the distance between the lower surface of said rotor and the top surface of said core plate member is 7 mm or less.

24. A classifying device as claimed in claim 1, wherein said core plate member has one or more openings so that said dispersing chamber is in fluid communication with said classifying chamber not only through said annular gap but also through each of said openings.

25. A classifying device as claimed in claim 24, wherein each of said openings is in the form of a slit and arranged in a peripheral portion of said core plate member.

26. A classifying device as claimed in claim 24, wherein one of said openings is a center opening located at a central portion of said core plate and wherein said classifying chamber is provided with a fine powder exhaust port at a position adjacent to said center opening.

27. A device for classifying solid particles into relatively fine particles and relatively coarse particles, comprising:

an upper, cylindrical housing having a vertically oriented central axis and defining therewithin a dispersing chamber, said upper housing being open ended at a bottom thereof and having an inside periphery;

feed port means connected to an upper part of said housing for feeding a jet stream comprising said solid particles and a carrier gas into said dispersing chamber in a direction tangential to the inside periphery of said cylindrical housing;

a core plate member coaxially disposed within said dispersing chamber to define an annular gap between the inside periphery of said cylindrical housing and said core plate member;

a lower housing having a cylindrical section coaxial with said upper housing and defining therewithin a classifying chamber, said cylindrical section having an inside periphery, said classifying chamber being connected to said bottom of said upper housing so that said classifying chamber is in fluid communication with said dispersing chamber through said annular gap, said lower housing having a collecting chamber below said classifying chamber;

a pipe member having one end located outside said lower housing for connection to evacuating means, said pipe member extending into and terminating at the other end in said classifying chamber to provide a fine powder exhaust port coaxial with said cylindrical section, said fine powder exhaust port having a periphery;

vanes provided in said cylindrical section of said lower housing and arranged so that air is fed to said classifying chamber in a direction tangential to the inside periphery of said cylindrical section to form a vortex flow when said classifying chamber is evacuated by said evacuating means, an annular, tapered plate member extending radially outward and obliquely downward from the periphery of said fine powder exhaust port, said tapered plate member having an outer periphery and terminating to provide an annular space between the inside periphery of said cylindrical section and the outer periphery of said tapered plate member, so that said classifying chamber is in fluid communication with said collecting chamber through said annular space, and a rotor disposed within said dispersing chamber and having a rotatable shaft extending coaxially with said cylindrical housing and a plurality of blades secured to said shaft for rotation therewith, whereby said solid particles introduced through said feed port means are dispersed by the revolution of said blades, then passed to said classifying chamber and separated into relatively small particles discharged through said fine powder exhaust port and relatively coarse particles collected in said collecting chamber through said space.

* * * * *